US006812894B2

(12) United States Patent
Shibata et al.

(10) Patent No.: US 6,812,894 B2
(45) Date of Patent: Nov. 2, 2004

(54) DIELECTRIC CHIP ANTENNA

(75) Inventors: Masaki Shibata, Mie (JP); Shi Luo, Mie (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 10/395,302

(22) Filed: Mar. 25, 2003

(65) Prior Publication Data

US 2003/0184483 A1 Oct. 2, 2003

(30) Foreign Application Priority Data

Mar. 26, 2002 (JP) ..... 2002-084867
Mar. 26, 2002 (JP) ..... 2002-084872

(51) Int. Cl.[7] ..... H01Q 1/26; H01Q 1/36
(52) U.S. Cl. ..... 343/700 MS; 343/895
(58) Field of Search ..... 343/700 MS, 895, 343/702, 845

(56) References Cited

U.S. PATENT DOCUMENTS 6,052,096 A * 4/2000 Tsuru et al. ..... 343/787
6,222,489 B1 * 4/2001 Tsuru et al. ..... 343/700 MS
6,442,399 B1 * 8/2002 Tsuru et al. ..... 455/575.7
6,683,572 B2 * 1/2004 Abe et al. ..... 343/700 MS
2002/0190906 A1 12/2002 Kim et al.

FOREIGN PATENT DOCUMENTS

EP 0 762 539 A1 3/1997
EP 0 777 293 A1 6/1997
JP 9051221 2/1997
JP 9055618 2/1997
JP 10-154906 A 6/1998
JP 2000013126 1/2000

* cited by examiner

*Primary Examiner*—Don Wong
*Assistant Examiner*—Minh Dieu A
(74) *Attorney, Agent, or Firm*—Stites & Harbison, PLLC; Ross F. Hunt, Jr.

(57) ABSTRACT

A dielectric chip antenna includes a substantially rectangular parallelepiped dielectric substrate, a feeding electrode, a fixation electrode, and two radiation electrodes. The feeding electrode is provided on one longitudinal end surface of the substrate, and is used to receive high frequency energy to be transmitted. The fixation electrode is provided on the opposite longitudinal end surface of the substrate and is used for fixation of the antenna to a printed circuit board. The two radiation electrodes are formed on a peripheral surface of the substrate so as to extend longitudinally while spirally surrounding the substrate. The base ends of the radiation electrodes are connected to the feeding electrode. The two radiation electrodes are formed symmetrically with respect to a horizontal plane passing through a center axis of the substrate so that the two radiation electrodes are of identical patterns on the upper and lower surfaces of the substrate.

7 Claims, 1 Drawing Sheet

DIELECTRIC CHIP ANTENNA

BACKGROUND OF THE INVENTION

1. Field of the Invention

The present invention relates to a dielectric chip antenna of the type used in portable terminals and radio communication devices.

2. Description of Related Art

Conventional dielectric chip antennas of the type referred to above are configured in such a manner that a single radiation electrode is formed on an outer surface of a dielectric substrate so as to assume a spiral or wound shape. One end of the radiation electrode is connected to a feeding or feed electrode, whereas the other end of the radiation electrode serves as a free end (see Japanese Patent Application Laid-Open (kokai) No. 2000-13126).

Laminated-type dielectric chip antennas are also known (see, e.g., Japanese Patent-Application Laid-Open (kokal) Nos. 9-51221 and 9-55618). These conventional laminated-type dielectric chip antennas are configured in such a manner that a plurality of dielectric layers each carrying a conductor line or element formed thereon are provided, and the conductor lines of the dielectric layers are electrically connected together by means of through-holes.

With increasing demands with respect to miniaturization and performance enhancement of portable terminals and radio-communication devices, chip antennas of the above-described types have been increasingly required to be of smaller and smaller sizes while also having a broader bandwidth.

In the latter regard, the bandwidth BW of a chip antenna can be represented as follows:

$$BW=k\cdot(C/L)^{1/2}$$

where L is the inductance of the antenna conductor, C is the capacitance between a capacitance generating conductor and ground, and k is a constant. Therefore, the bandwidth BW becomes broader, i.e., is greater, when the capacitance C between the capacitance generating conductor and ground is increased, and when; the inductance L is reduced.

Conventional chip antennas as described above cannot satisfactorily meet both the requirements of reduced size and broadened bandwidth. Further, during the assembly of conventional chip antennas, when a worker mounts such a small chip antenna onto a printed circuit board, the worker must check whether the upper side or lower side (i.e., front side or reverse side) of the chip antenna faces upwardly, thus adding a cumbersome step to the assembly process.

SUMMARY OF THE INVENTION

In view of the foregoing, an object of the present invention is to provide a dielectric chip antenna which can meet both the requirements of reduced size and broadened bandwidth.

Another object of the present invention is to provide a dielectric chip antenna of a construction which facilitates mounting thereof onto a printed circuit board.

In order to achieve the above objects, in accordance with the present invention, there is provided a dielectric chip antenna comprising a substantially rectangular parallelepiped dielectric substrate; a feeding electrode for receiving high-frequency energy to be transmitted by the antenna, the feeding electrode being disposed on one longitudinal end surface of the dielectric substrate; a fixation electrode to be used for fixation of the dielectric chip antenna, the fixation electrode being disposed on the opposite longitudinal end surface of the dielectric substrate; and first and second radiation electrodes formed on a peripheral surface of the dielectric substrate so as to extend longitudinally while spirally surrounding the dielectric substrate, base ends of the radiation electrodes being connected to the feeding electrode.

Preferably, the two radiation electrodes are connected to the feeding electrode on opposite lateral side surfaces of the dielectric substrate.

Because the twb radiation electrodes connected to the feeding electrode are formed so as to spirally surround the dielectric substrate, the center frequency of the antenna can be shifted downwardly, i.e., to a lower frequency, by about 10 % as compared with a chip antenna wherein a single radiation electrode is spirally wound around a dielectric substrate, as disclosed in the above-mentioned Japanese Patent Application Laid-Open No. 2000-13126, where the dielectric substrate is of the same size. Therefore, with the construction of the invention, the overall size of the dielectric chip antenna can be reduced. Further, because the capacitance C between the capacitance generating conductor (radiation electrode) and ground can be increased, the bandwidth of the antenna can be broadened.

Preferably, the two, radiation electrodes are formed symmetrically with respect to a horizontal plane passing through a center axis of the dielectric substrate, so that the two radiation electrodes form identical patterns on the upper and lower surfaces of the dielectric-substrate.

With such a construction, a worker can mount the dielectric chip antenna onto a printed circuit board without checking whether the upper side or lower side of the chip antenna faces upwardly. Therefore, the effort required in mounting the dielectric chip antenna can be significantly reduced, i.e., the cumbersome step of determining whether the upper or lower side of the substrate faces upwardly can be eliminated.

More preferably, the feeding electrode extends an equal amount onto the upper and lower surfaces of the dielectric substrate.

Further features and advantages of the present invention will be set forth in, or apparent from, the detailed description of preferred embodiments thereof which follows.

DESCRIPTION OF THE PREFERRED EMBODIMENTS

A preferred embodiment of the present invention will now be described with reference to the accompanying drawings.

Figure 1:
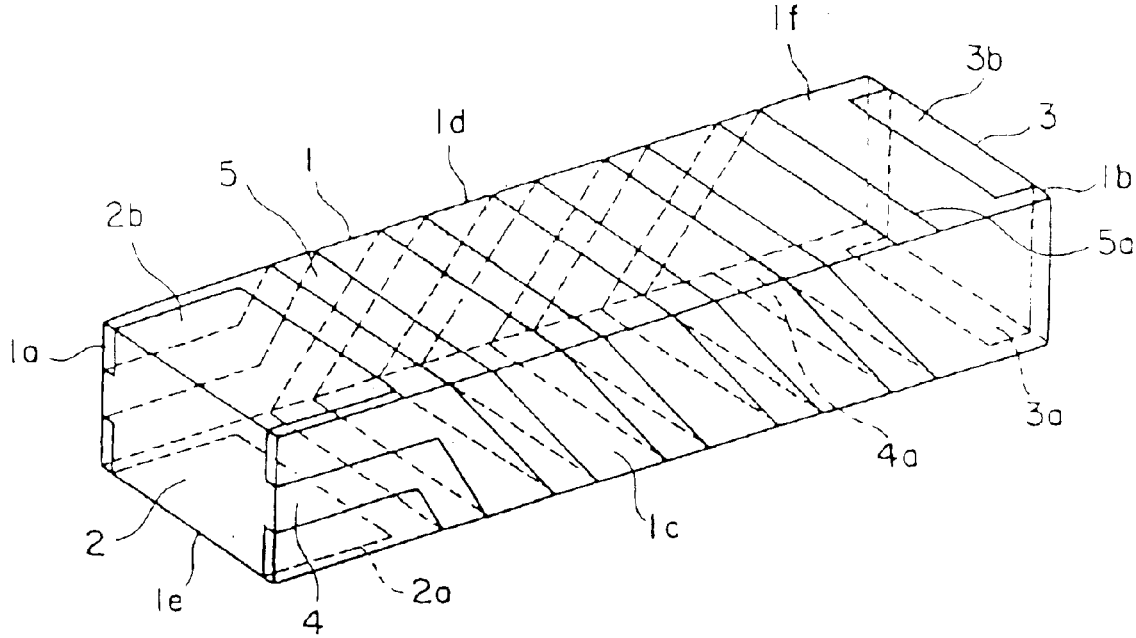
FIG. 1 is a schematic perspective view showing a main portion of a dielectric chip antenna according to a preferred embodiment of the present invention.

FIG. 1 shows a dielectric chip antenna according to a presently preferred embodiment. The illustrated dielectric chip antenna includes a substantially rectangular parallelepiped dielectric substrate 1, which is preferably formed of a dielectric ceramic having a relatively high dielectric constant.

A feeding electrode 2 and a fixation electrode 3 are provided on opposite longitudinal end surfaces, respectively, of the dielectric substrate 1, i.e., on the end surfaces of substrate 1 at opposite ends thereof as viewed longitudinally. The feeding electrode 2 is formed on a first longitudinal end surface 1*a* of the dielectric substrate 1 in such a manner that, as indicated by reference numerals 2*a* and 2*b* representing orthogonal extension portions of electrode 2, the feeding electrode 2 extends over a relatively long distance on each of the upper and lower surfaces of substrate 1 adjacent to the first end surface 1*a* . The feeding electrode 2 is connected to an unillustrated transmission circuit so as to receive therefrom highfrequency energy to be transmitted.

The fixation electrode 3 is formed on a second, opposed longitudinal end surface 1*b* of the dielectric substrate 1 in such a manner that, as indicated by reference numerals 3*a* and 3*b* representing orthogonal extension portions of electrode 3, the fixation electrode 3 extends over a relatively short distance on each of the upper and lower surfaces adjacent to the second end surface. The fixation electrode 3 is used to fix or secure the dielectric chip antenna to an unillustrated printed circuit board.

In summary with respect to electrodes 2 and 3, the positioning of the electrodes 2 and 3 is such that electrodes 2 and 3 are disposed symmetrically with respect to a horizontal plane passing through the center axis of the dielectric substrate 1.

In addition, first and second parallel radiation electrodes 4 and 5 are formed on a peripheral surface of the dielectric substrate 1 in a spiral form, i.e., so as to spirally surround the dielectric substrate 1, from the first longitudinal end to the second longitudinal end of the dielectric substrate 1.

More specifically, the first radiation electrode 4 starting from one lateral end of the feeding electrode 2 adjacent to a first lateral side surface 1*c*, extends parallel to the longitudinal direction of the first lateral side surface 1*c*, bends obliquely downwardly, crosses perpendicularly over a lower surface 1*e*, bends obliquely upwardly along the opposite or second lateral side surface 1*d*, crosses perpendicularly over an upper surface 1*f*, and then bends obliquely downwardly along the first lateral side surface 1*c*. Following this pattern, the first radiation electrode 4 extends to a point near the extension portion 3*a* of the fixation electrode 3, while spirally surrounding the dielectric substrate 1, such that a free end 4*a* of the first radiation electrode 4 ends at a boundary line or edge between the lower surface 1*e* and the second lateral side surface 1*d* of the dielectric substrate 1.

Similarly, the second radiation electrode 5, starting from the other lateral end of the feeding electrode 2 adjacent to the second lateral side surface 1*d* extends parallel to the longitudinal direction of the second lateral side surface 1*d*, bends obliquely upwardly, crosses perpendicularly over the upper surface if, bends obliquely downwardly along the first lateral side surface 1*c*, crosses perpendicularly over the lower surface I e, and then bends obliquely upwardly along the second lateral side surface 1*d*. In this manner, i.e., following this pattern, the second radiation electrode 5 extends to a point near the extension portion 3*b* of the fixation electrode 3, while spirally surrounding the dielectric substrate 1, such that a free end 5*a* of the second radiation electrode 5 ends at a boundary line or edge between the upper surface 1*f* and the first lateral side surface 1*c* of the dielectric substrate 1.

The feeding electrode 2, the fixation electrode 3, and the two radiation electrodes 4 and 5 are preferably formed by using a film forming process in which silver, gold, copper, or an alloy containing any of these metals as a predominant component is printed or deposited on the surface of the dielectric substrate 1 by means of, for example, screen printing, vapor deposition, plating or the like.

Exemplary, non-limiting dimensions of the illustrated dielectric chip antenna fabricated in the above-described manner are set forth below.

Size of the dielectric substrate 1:9 mm (length)×3 mm (width)×1.6 mm (height);

Size of the feeding electrode 2: 1.6 mm (length)×2.6 mm (width);.

Figure 2:
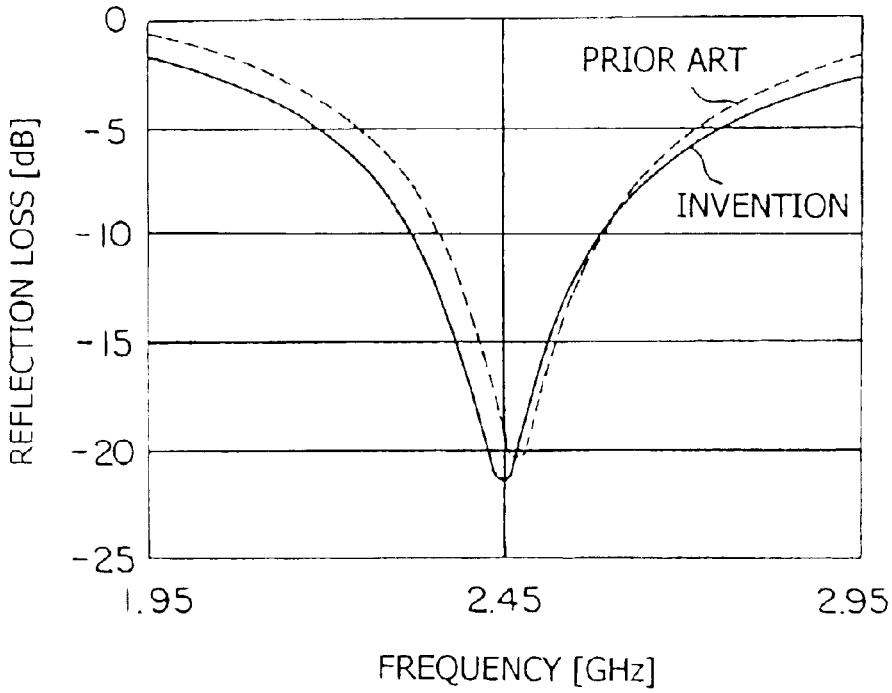
FIG. 2 is a graph showing the frequency characteristics of the dielectric chip antenna of FIG. 1 (solid line) with a prior art chip antenna (dashed line).

Size of the extensions 2*a* and 2*b* of the feeding electrode 2: 1.5 mm (length) x 2.6 mm (width);

Size of the fixation electrode 3: 1.6 mm (length)×2.4 mm (width);

Size of the extensions 3*a* and 3*b* of the fixation electrode 3: 0.5 mm (length) x 2.4 mm (width);

Size of the radiation electrode 4: 26.3 mm (length)×2.0 mm (width);

Size of the radiation electrode 5: 26.3 mm (length)×2.0 mm (width);

FIG. 2 illustrates the frequency characteristic (shown by a solid line) of the dielectric chip antenna shown in FIG. 1, and contrasts it with the frequency characteristic (shown by a dashed or broken line) of an antenna having a conventional configuration in which a single radiation electrode is spirally wound around a dielectric substrate. As can be seen from FIG. 2, the dielectric chip antenna of the present invention has a center frequency to, which is shifted from that of the conventional antenna toward the lower frequency side by about 10 %. Further, the dielectric chip antenna of the present invention has a bandwidth BW of 0.25 GHz to 0.28 GHz, which is-about 12% broader than that of the antenna having the conventional configuration (shown by a dashed or broken line).

Although the invention has been described above in relation to preferred embodiments thereof, it will be understood by those skilled in the art that variations and modifications can be effected in-these preferred embodiments without departing from the scope and spirit of the invention.

What is claimed:

1. A dielectric chip antenna comprising:

a substantially rectangular parallelepiped dielectric substrate including first and second opposed longitudinal end surfaces;

a feeding electrode for receiving high-frequency energy to be transmitted by the dielectric chip antenna, the feeding electrode being disposed on said first longitudinal end surface of the dielectric substrate;

a fixation electrode to be used for fixation of the dielectric chip antenna, the fixation electrode being disposed on said second longitudinal end surface of the dielectric substrate; and first and second radiation electrodes formed on a peripheral surface of the dielectric substrate so as to extend longitudinally while spirally surrounding the dielectric substrate, the radiation electrodes including base ends connected to the feeding electrode.

2. A dielectric chip antenna according to claim 1 wherein the first and second radiation electrodes are connected to the feeding electrode on opposite lateral side surfaces of the dielectric substrate.

3. A dielectric chip antenna according to claim 1 wherein the substrate has upper and lower surfaces and wherein the first and second radiation electrodes are formed symmetrically with respect to a horizontal plane passing through a center axis of the dielectric substrate so that the first and second radiation electrodes form identical patterns on the upper and lower surfaces of the dielectric substrate.

4. A dielectric chip antenna according to claim 1, wherein the substrate has upper and lower surfaces and wherein the feeding electrode extends an equal amount onto the upper and lower surfaces of the dielectric substrate from said first longitudinal end surface.

5. A dielectric chip antenna comprising:

a substantially rectangular parallelepiped dielectric substrate including first and second opposed longitudinal end surfaces, and upper and lower surfaces;

a feeding electrode for receiving high-frequency energy to be transmitted by the dielectric chip antenna, the feeding electrode being disposed on said first longitudinal end surface of the dielectric substrate;

a fixation electrode to be used for fixation of the dielectric chip antenna, the fixation electrode being disposed on said second longitudinal end surface of the dielectric substrate; and first and second radiation electrodes formed on a peripheral surface of the dielectric substrate so as to extend longitudinally while spirally surrounding the dielectric substrate, the radiation electrodes including base ends connected to the feeding electrode, said first and second radiation electrodes being formed symmetrically with respect to a horizontal plane passing through a center axis of the dielectric substrate so that the first and second radiation electrodes form identical patterns on the upper and lower surfaces of the dielectric substrate.

6. A dielectric chip antenna according to claim 5, wherein the feeding electrode extends an equal amount onto the upper and lower surfaces of the dielectric substrate from said first longitudinal end surface.

7. A dielectric chip antenna according to claim 5, wherein the first and second radiation electrodes are connected to the feeding electrode on opposite lateral side surfaces of the dielectric substrate.

* * * * *